US005619241A

United States Patent [19]

Hosoi et al.

[11] Patent Number: 5,619,241

[45] Date of Patent: Apr. 8, 1997

[54] INK-JET PRINTING PAPER AND INK-JET PRINTING METHOD USING THE SAME

[75] Inventors: Kiyoshi Hosoi; Tsukasa Matsuda, both of Kanagawa, Japan

[73] Assignee: Fuji Xerox Co., Ltd., Tokyo, Japan

[21] Appl. No.: 447,958

[22] Filed: May 23, 1995

Related U.S. Application Data

[63] Continuation of Ser. No. 84,179, Jul. 1, 1993, abandoned.

[30] Foreign Application Priority Data

Jul. 2, 1992 [JP] Japan ..... 4-197462

[51] Int. Cl.[6] ..... B41J 2/01

[52] U.S. Cl. ..... 347/105; 428/195

[58] Field of Search ..... 347/105; 428/195

[56] References Cited

U.S. PATENT DOCUMENTS

| | | | |
|---|---|---|---|
| 4,425,405 | 1/1984 | Murakami | 347/105 X |
| 4,474,847 | 10/1984 | Schroder | 347/105 X |
| 4,478,910 | 10/1984 | Oshima | 347/105 X |
| 4,542,059 | 9/1985 | Toganoh | 347/105 X |
| 4,701,837 | 10/1987 | Sakaki | 347/105 X |
| 4,758,461 | 7/1988 | Akiya | 347/105 X |
| 4,770,934 | 9/1988 | Yamasaki | 347/105 X |
| 4,900,620 | 2/1990 | Tokita | 347/105 X |
| 4,931,810 | 6/1990 | Iwata | 347/105 X |
| 4,965,612 | 10/1990 | Sakaki | 347/105 |
| 5,213,873 | 5/1993 | Yasuda | 428/195 |

FOREIGN PATENT DOCUMENTS

| | | | |
|---|---|---|---|
| 60-27588 | 6/1985 | Japan | B41M 5/00 |
| 2-16078 | 1/1990 | Japan | B41M 5/00 |
| 2-16079 | 1/1990 | Japan | B41M 5/00 |

*Primary Examiner*—Joseph W. Hartary

*Attorney, Agent, or Firm*—Finnegan, Henderson, Farabow, Garrett & Dunner, L.L.P.

[57] ABSTRACT

The printing paper can be formed by applying a slight amount of paint including a white pigment having a given BET specific surface area onto at least one side surface of base paper having a given apparent density. Also, according to the printing paper, in a time T=L/S to be determined by the shortest inter-nozzle distance L of different colors of a multi-color ink-jet printer and a printing paper/head relative moving speed S, the ink absorbing capacity V of the printing paper according to a blister method satisfies the following equation: $V \geqq 2ax^2/(0.0254)^2$ (where a represents an amount of ink drop to be jetted out from a nozzle, and x represents definition). The present ink-jet printing method uses the above-mentioned printing paper.

7 Claims, 1 Drawing Sheet

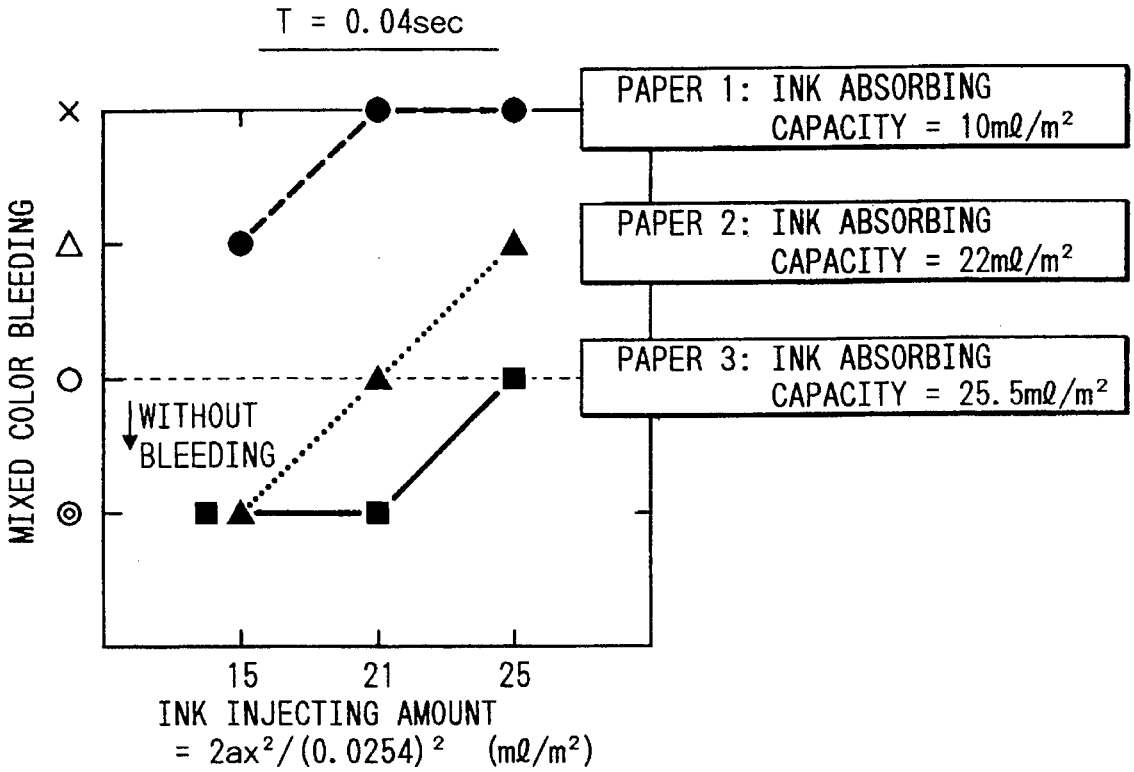
FIG. 1(b)
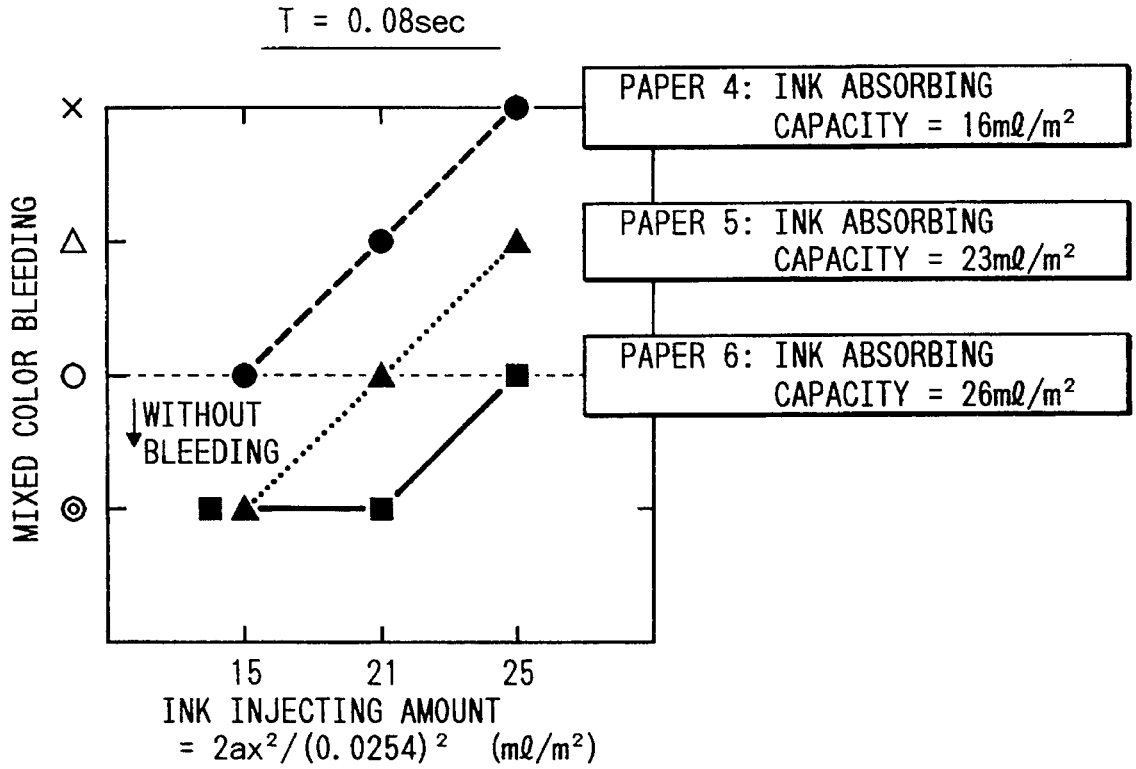

INK-JET PRINTING PAPER AND INK-JET PRINTING METHOD USING THE SAME

This application is a continuation of application Ser. No. 08/084,179, filed Jul. 1, 1993, now abandoned.

BACKGROUND OF THE INVENTION

The present invention relates to ink-jet printing paper suited for obtaining a high quality image free from the mixed color running of ink and the like, in performing multi-color ink-jet printing by use of water color ink, and an ink-jet printing method using the same printing paper.

Conventionally, as ink-jet printing paper, there has been proposed ink-jet printing paper whose ink absorbing property is improved, in order to obtain an image of a higher quality.

For example, Japanese Patent Examined Publication No. Sho. 60-27588 discloses a printing paper which is formed by applying a paint having a higher ink absorbing property (of the order of 11 to 13 g/m$^2$ in a dry amount of paint) on original paper of a higher sizing degree.

However, since a relatively large amount of paint is applied to the printing paper, such printing paper gives different feel and appearance from so called ordinary paper such as copying paper used in an office and the like, and such printing paper is expensive. Further, since the paint layer thus applied is poor in strength, when it is folded or rubbed, powder drop is easily generated in the paper. The paper powder can be attached to a feeding roll for the paper, which can result in the poor paper feeding and also in the clogged ink-jet head.

In order to solve the above-mentioned problems, as disclosed in Japanese Patent Laid-Open No. Hei. 2-16079, there is proposed printing paper in which a paint layer (or, an ink receiving layer) is formed thin and the roughness factor of the surface of the paint layer is set not less than 10 ml/m$^2$ or the Beck smoothness of the paint layer is set not more than 20 sec. Also, as disclosed in Japanese Patent Laid-Open No. Hei. 2-16078, there is proposed an ink-jet printing method using printing paper in which a paint layer is formed thin (the dry amount of paint is of the order of 0.6 to 10 g/m$^2$) and the amount of initial transfer of the printing paper (that is, the ink absorbing capacity in the time of contact, 10 ms, of the printing paper with ink according to a blister method) is more than the maximum printing density (that is, an upper limit amount of ink to be applied by a printer).

Concerning the printing paper disclosed in the above-mentioned Reference No. Hei. 2-16079, the paper is caused to minimize the amount of paint to be applied (that is, the amount of paint when dried is approximately 0.6 to 6.0 g/m$^2$) and to rough the surface of the paint layer, to thereby prevent powder drop from generating in the printing paper and prevent an ink running at a boundary portion of different colors (that is, bleeding) in the printing. But, specifically, when performing a higher density printing of a definition of 300 dpi or more at a higher speed, there arises a problem in the printing paper that mixed color bleeding occurs in the printing portion where different colors of ink are superimposed on one another. The reason why such mixed color bleeding occurs is that, in the higher-speed and higher density printing, a time period from the printing of a first color to the printing of a second color is too short and the applied amount of the ink per unit area becomes large and, therefore, these two colors cannot be absorbed quickly by only roughening the paint layer surface thereof. Also, in the printing paper, since the paint layer surface is roughened, the ink flows into the recessed portion of the roughened surface, and the ink is disturbed to spread over the paper surface, which results in the ununiform dot shapes. As a result, the quality of the image is lowered.

Further, in the printing method disclosed in the above-mentioned reference No. Hei. 2-16078 as well, when executing a high density printing with the definition of 300 dpi or more at a higher speed, there is the mixed color bleeding in the printing portion where different colors of ink are superimposed.

At the time, the contact time period 10 ms, between the printing paper and ink according to the blister method regulating the initial transfer amount of the printing paper used in the printing method, corresponds to the wetting period of ink on the surface of the printing paper and such wetting period is greatly influenced by the roughened state of the surface of the printing paper. For the reason, in order to make the initial transfer amount of the printing paper in the contact time period 10 ms larger than the ink discharge amount in the time of the upper limit of the printing density, roughness of the printing paper surface must be increased, with the result that, in the printing paper as well, the ink flows into the recessed portion of such roughened surface, which makes it impossible to prevent the mixed color bleeding sufficiently and also makes ununiform the shapes of dots, so that the quality of the image is lowered.

SUMMARY OF THE INVENTION

The present invention aims at eliminating the above-mentioned problems found in the conventional printing paper and printing method. Accordingly, it is an object of the invention to provide an ink-jet printing paper which, even when multiple-colors are printed thereon at a higher speed and at a definition having a higher density of 300 dpi or more, hardly allows mixed color running to occur and can provide a higher quality image excellent in the clear coloring property and definition, and an ink-jet printing method using the same printing paper.

BRIEF DESCRIPTION OF THE DRAWINGS

FIG. 1(*a*) and FIG. 1(*b*) are graphical representations of correlation between the ink absorbing capacity, ink jet-out amount and mixed color bleeding of the printing paper at respective times T=0.04 and 0.08.

DESCRIPTION OF THE PREFERRED EMBODIMENTS

The present inventors have made energetic and repetitional studies to solve the above problems, specifically on the problem as to the mixed color bleeding, and have so far confirmed that the mixed color bleeding is apt to occur in a printing portion especially where two color rush print images are superimposed. The reason for this seems to us that, after the first color of ink is printed but before it is absorbed into the printing paper sufficiently, the second color of ink is printed in the same position superimposedly on the first color of ink and, therefore, the second color of ink is caused to flow over the printed position, that is, the mixed color is caused to run. We have made further many studies on the basis of this confirmation and have finally found out that the mixed color bleeding can be prevented by increasing the ink absorbing speed into the printing paper and also by increasing the ink absorbing capacity of the printing paper. In this manner, the present inventors have developed the present invention.

In order words, the ink-jet printing paper of the invention is printing paper which includes base paper having an apparent density of 0.60 to 0.80 g/cm$^3$ and a paint containing a white pigment having a BET specific surface area of 200 to 400 m$^2$/g applied onto at least one side surface of the base paper in such a manner that an amount of the paint when dried shows 2 to 10 g/m$^2$, and at the same time which, in a time T (s)=L/S when an ink absorbing capacity V (ml/m$^2$) per unit area of printing paper according to the blister method is determined by the shortest nozzles distance L (mm) of different colors in a multi-color ink-jet printer and printing paper/head relative moving speed S (mm/s), satisfies the following equation (1):

$$V \geqq 2ax^2/(0.0254)^2 \quad (1)$$

where, a represents an amount of ink drop (ml) to be jetted out from one nozzle, and x represents a resolution (dpi).

Also, the ink-jet printing method of the invention is characterized in that, when performing a multi-color ink-jet printing operation by use of water ink, it uses, as the printing paper thereof, the ink-jet printing paper having the above-mentioned structure.

Further, the printing method of the invention is characterized in that, as the water ink mentioned in the above technical means, there is used water ink which has a surface tension of 40 dyn/cm or less at a temperature of 20° C.

The above-mentioned equation (1) in the present invention is established for the following reason: that is, in the case of a multi-color (full color) ink-jet printer of an ink-jet head moving type, the mixed color bleeding is influenced by the distance between the nozzles, printing paper/head relative moving speed, and ink jet-out amount thereof. Therefore, the present inventors have found out that, in order to prevent the mixed color bleeding from occurring, within the shortest time that is taken from the printing of a first color of ink to the printing of a second color of ink and that can be determined by the inter-nozzle distance and the printing paper/head relative moving speed of the printer, the ink absorbing capacity per unit area of the printing paper may be equal to or more than the maximum ink jet-out amount of at least 2 colors to be jetted out per unit area from the printer. That is, this relationship is represented by the equation (1).

Here, the ink absorbing capacity V of the printing paper, unless special ink for measurement and time are applied, is measured in accordance with a blister method which is set forth in J. TAPPI paper pulp test method No. 51–87. Also, the numeral value 0.0254 in the above equation is a conversion coefficient which is used to convert an inch unit in the definition x (dpi=dots/inch) into [mm] unit.

Referring to FIG. 1, there is shown a relation between the ink absorbing capacity, ink jet-out amount and mixed color bleeding of the printing paper under the following conditions.

That is, by use of a multi-color ink-jet printer having a definition x of 300 dpi, the inventors conducted a test in which the ink drop amount a (ml) of a nozzle was changed to thereby change the ink jet-out amount expressed by $2ax^2/(0.0254)$ per unit area into three standards (that is, 15 ml/m$^2$, 21 ml/m$^2$, and 25 ml/m$^2$), the time T (s)=L/S to be determined by the shortest inter-nozzle distance L (mm) of different colors and the printing paper/head relative moving speed S (mm/s) was changed into two standards (that is, 0.04 s, and 0.08 s), and rush images in two colors of ink were printed by superimposing one on the other in a total of six kinds of printing paper 1 to 6 respectively having different ink absorbing capacity V according to a blister method. And, the inventors studied the conditions of occurrence of the mixed color bleeding in the six kinds of printing paper. That is, the results of the study on the mutual relationship between the ink absorbing capacity, ink jet-out amount and mixed color tuning are shown in FIG. 1.

In FIG. 1, a symbol ⊚ shows that the mixed color bleeding did not occur, ○ shows that the mixed color bleeding occurred but only slightly, Δ shows that the mixed color bleeding occurred somewhat, and × shows that the mixed color bleeding occurred.

The ink absorbing property in the six kinds of printing paper was measured and evaluated also by use of other methods than the above-mentioned blister method, including a stöckigt size degree method (JIS-P-8122), Cobb size degree method (JIS-P-8140) and Clemm's water absorbing degree method (JIS-P-8141). However, none of the st öckigt size degree, Cobb size degree and Clemm's water absorbing degree are suited to evaluate the absorbing property in a short time and, therefore, they cannot be used as a proper evaluation standard to study a relation between the mixed color bleeding occurring in a short time and ink absorbing property.

On the other hand, in the blister method, the contact time period of ink and printing paper can be changed arbitrarily and the water absorbing property can be evaluated in a short time of the order of several milliseconds. For this reason, the blister method is suited to investigate a relation between the mixed color bleeding and ink absorbing property. In other words, according to the blister method, it is possible to measure the ink absorbing capacity of the printing paper in a time necessary from the printing of the first color of ink to the printing of the second color of ink.

Therefore, here, there was used water ink used in a multi-color ink-jet printer and the moving speed of the moving speed of the printing paper was adjusted in such a manner that the measuring time in the blister method provides the above-mentioned time T (0.04 s, 0.08 s). After then the ink absorbing capacities in the respective kinds of the printing paper were found. In particular, the ink absorbing capacities of the paper 1, paper 2 and paper 3 respectively shown in FIG. 1 (*a*) were measured under the condition of T=0.04 s, while the ink absorbing capacities of the paper 4, paper 5 and paper 6 respectively shown in FIG. 1 (*b*) were measured under the condition of T=0.08 s.

As can be understood clearly from the results shown in FIG. 1, the printing paper in which the mixed color bleeding does not occur in the ink-jet printing by use of the multi-color ink-jet printer of the above-mentioned head moving type is one whose ink absorbing capacity V is equal to or greater than the ink jet-out amount represented by $2ax^2/(0.0254)^2$ in both of the times of T=0.04 s and 0.08 s.

Also, the present inventors made similar studies on a multi-color ink-jet printer of a fixed head type in which the head for injecting the ink is fixed and printing paper is movable, instead of the above-mentioned head moving type printer. In this case, similarly, it has been confirmed that no mixed color bleeding occurs in the printing paper whose ink absorbing capacity V according to the blister method is equal to or greater than the ink jet-out amount represented by $2ax^2/(0.0254)$ in any of the time T.

As the base paper forming the printing paper of the invention, normally, there may be used paper which is mainly formed of wood pulp and, according to cases, there may be used paper which is formed of wood pulp mixed with glass fiber, synthetic fiber or the like. Filler is mixed into the base paper. As the filler, there can be used white filler such as heavy or light calcium carbonate, talc, kaolin clay, titanium dioxide, zeolite, white carbon or the like and, especially, calcium carbonate is preferable because it can improve the coloring property of color material. The filler is mixed at a rate of weight percent of 5 to 30%, preferably, weight percent of 10 to 25%, in order to increase the air gap of the base paper or improve the opacity of the base paper. When the filler is mixed at a rate of 30% by weight or greater, then the strength of the base is lowered greatly and paper powder is generated greatly.

The base paper has an apparent density of 0.60 to 0.80 g/cm$^3$, preferably, in the range of 0.65 to 0.78 g/cm$^3$. If the apparent density is less than 0.60 g/cm$^3$, then the printed image can be reflected on the other side (which is hereinafter referred to as back reflection as well) or, when a paint to be described later is applied to the base member, the binder component of the paint can permeate into the base paper to thereby lower the strength of the paint layer. On the other hand, if the apparent density is greater than 0.80 g/cm$^3$, then the absorbing speed of ink is lowered, which makes it easy for the mixed color bleeding to occur.

The base paper is manufactured in such a manner that its basis weight is 50 to 100 g/cm$^2$, preferably, 60 to 90 g/cm$^2$ and its thickness is 65 to 150 μm, preferably, 80 to 140 μm. If the basis weight is less than 50 g/cm$^2$, then the back reflection is easy to occur. On the hand, if the basis weight is greater than 100 g/cm$^2$, then the stiffness of the paper is increased to thereby increase the buckling force of the paper, which makes it easy to invite delivery trouble in the printing device. Also, similarly, if the paper thickness is less than 65 μm, then the back reflection and the like can occur. On the other hand, if the paper thickness is greater than 150 μm, then the stiffness of the paper is increased and thereby the buckling force thereof is also increased, which makes it easy to invite delivery trouble in the printing device.

Also, the stöckigt size degree (JIS P 8122) of the base paper is preferably 2 to 18 sec. and, most preferably, 5 to 15 sec. If the stöckigt size degree is less than 2 sec., then the back reflection can occur or the binder of the paint can permeate into the base paper to thereby reduce the strength of the paint layer. On the other hand, if the stöckigt size degree is greater than 18 sec., then the ink absorbing speed is decreased, with the result that the mixed color bleeding is easy to occur.

As the paint to be applied to at least one side surface of the base paper having such a high ink absorbing property, there may be used a paint including a white pigment which has a BET specific surface area of 200 to 400 m$^2$/g, preferably, 300 to 400 m$^2$/g and an average grain diameter of 2 to 15 μm. As the white pigment having such properties, for example, non-crystal silica is best. Also, the white pigment is mixed into the paint 50 to 85% by weight, preferably, 60 to 80% by weight.

If the BET specific surface area of the white pigment is less than 200 m$^2$/g, then the ink absorbing speed in the paint layer is decreased to thereby facilitate the generation of the mixed color bleeding, which is unfavorable. And, if the BET specific surface area is 200 m$^2$/g or more, then no mixed color bleeding occurs at all and the coloring property of the ink is improved. On the other hand, if the BET specific surface area is greater than 400 m$^2$/g, then the hardness of the pigment is lowered to thereby turn the pigment into a soft pigment, so that it is difficult to write on the paper with a pencil and the like. Also, if the average grain diameter of the pigment is less than 2 μm, then it is difficult to write on the paper with a pencil and the like. On the other hand, if the average grain diameter is greater than 15 μm, then the unevenness of the surface of the paint layer is increased to thereby allow the ink to flow out laterally in the dent, with the result that the shapes of dots can be made ununiform in printing and the mixed color bleeding is easy to occur. Further, if the mixing amount of the white pigment is less than 50% by weight, then a similar ill effect can be produced as in the above-mentioned case where the BET specific surface area is less then 200 m$^2$/g. On the other hand, if the mixing amount is greater than 85% by weight, then the strength of the paint layer is decreased, which facilitates the generation of the powder drop and makes it difficult to write with a pencil and the like.

Also, since the white pigment such as non-crystal silica and the like gives a water resisting property, light resistance and the like, the white pigment may be modified by a metal ion having a cationic property such as Ca, Al, Mg and the like. Further, according to objects, there may be mixed a small amount of pigment which has a BET specific surface area of less than 200 m$^2$/g.

As the binder component of the paint, the following can be used alone or in combination, which includes a polyvinylalcohol derivative such as completely saponified polyvinylalcohol, partially saponified polyvinylalcohol, silanol group denatured vinylalcohol copolymer and the like; a cellulose derivative such as carboxylmethylcellulose, hydroxyethylcellulose, hydroxypropylmethylcellulose and the like; and, a water-soluble macromolecule such as polyvinylpyrrolidone, oxidized starch, denatured starch, gelatin, casein, acrylic acid system polymer and the like. Among them, polyvinylalcohol system macromolecule such as completely saponified polyvinylalcohol, partially saponified polyvinylalcohol, silanol group denatured vinylalcohol copolymer and the like is preferable from the point of view of the strength of the paint layer. Further, silanol group denatured vinylalcohol copolymer is most preferable due to the fact that it can improve the strength of the paint layer to thereby be able to increase the mixing amount of a pigment which is used to catch dye contained in the ink.

Also, in order to give the water resisting property of the water ink image to the paint layer, there can be used individually or in combination amine system macromolecule such as polyethylene-imine, polyacryl-amine and the like and the quaternary salt thereof, cationic water macromolecule consisting of a copolymer composed of an acrylic-system compound and ammonium salt and the like, and water metal salt. Further, according to needs, a fluorescent whitening agent, a surface active agent, an anti-mold agent, a dispersing agent and the like may be added to the paint.

In the printing paper of the invention, the above-mentioned paint is applied to at least one side surface of the previously described base paper in such a manner that the dry amount of the paint is 2 to 10 g/m$^2$, preferably, 3 to 8 g/m$^2$. If the dry amount of the paint is less than 2 g/m$^2$, then the mixed color bleeding can occur and the resultant paper can lack in the clear coloring property thereof. On the other hand, if the dry amount of the paint is greater than 10 g/m$^2$, then the strength of the paint layer itself is decreased. As painting means, there can be conveniently employed a reverse coater, an air knife coater, a blade coater, a gate roll coater and the like.

Also, in the present invention, in order that a dot to be printed on the printing paper is near a true circle in shape and is not so rough, according to needs, the surface of the printing paper may be finished by means of a super calender processing or the like in such a manner that the Beck smoothness thereof is 25 sec. or more, preferably, in the range of 25 to 100 sec., provided that the given apparent density (0.60 to 0.80 g/cm$^3$) of the base paper is secured.

The printing method of the invention, basically, is a method to be performed by applying the above-structured ink-jet printing paper to a conventionally known ink-jet printing method using water ink. The present printing method can prevent the mixed color bleeding from occurring especially when a multi-color printing is executed, and can also provide an image which is excellent in the coloring property, clearness, and definition.

Also, according to the printing method of the invention, by using water ink which has a surface tension of 40 dyn/cm or less, preferably, in the range of 25 to 40 dyn/cm, more preferably, in the range of 30 to 40 dyn/cm at a temperature of 20° C., it is possible to prevent the occurrence of the mixed color bleeding more surely when a multi-color printing operation is executed and, at the same time, it is possible to obtain an image of high quality which is further excellent in the coloring property, clearness, and definition thereof.

Therefore, if ink having a surface tension of greater than 40 dyn/cm is used, in some cases the occurrence of the mixed color bleeding can be prevented to some degree, while in most cases the mixed color bleeding occurs. On the other hand, if the surface tension of ink to be used is less than 30 dyn/cm, then the jetting-out of ink from a head nozzle is easy to be unstable, and the usable select width of an ink-jet head is limited. Further, if the ink surface tension is less than 25 dyn/cm, then the poor jetting-out of ink from the head nozzle is easy to occur.

As the dye of the water ink to be used in the present printing method, there can be used water-soluble acid dye, direct dye, basic dye, reactive dye, food color and the like which have been conventionally known. Also, the content of the dye in the ink may be 0.5 to 15% by weight, preferably, 1 to 10% by weight.

Also, with respect to a solvent for the water ink, water which is demineralized may be preferably used as a main solvent. And, it is preferable that a humidity keeping agent may be contained in the solvent mainly in order to prevent the solvent from being dried in the head nozzle. As the humidity keeping agent, for example, there can be used polyvalent alcohol such as ethyleneglycol, diethyleneglycol and the like, but this is not always limitative.

The surface tension of ink can be adjusted by adding a proper amount of a surface tension adjusting agent to the solvent. As the surface tension adjusting agent, there can be used various kinds of adjusting agents and, preferably, two kinds of adjusting agents may be pointed out which are mainly classified as follows:

(1) Anionic surface active agents such as higher alcohol sulfate, higher alkyl ether sulfate, alkyl benzene sulfonate, α-olefin sulfonate, phosphate of higher alcohol ethylene oxide addition product and the like. Cationic surface active agents such as amine salt type, quaternary ammonium salt type and the like. Amphoteric surface active agents such as an amino acid type, a betaine type and the like. Nonionic surface active agents such as a higher alcohol ethylene oxide addition product, an alkyl phenol ethylene oxide addition product, a fatty acid ethylene oxide addition product, an ethylene oxide addition product of higher aliphatic amine and fatty acid amide, fatty acid ester of glycerol and pentaerythritol, fatty acid ester of sugar, fatty acid alkanol amid, an oxidized ethylene/oxidized propylene block copolymer and the like. Silicone-system and fluorine-system ionic and nonionic surface active agents.

(2) Materials which are normally not classified as surface active agents but are believed to have a weak surface active performance, having a water soluble portion or a hydrophilic portion whose surface tension is about 40 dyn/cm or less, preferably, about 35 dyn/cm or less. For example, propylene glycol, polypropylene glycol. Ether such as alkyl or alkyl phenyl of polyhydric alcohol of ethylene glycol, di-ethylene glycol, tri-ethylene glycol, tetra-ethylene glycol, propylene glycol, glycerol and the like. Acid derivatives such as ethylene carbonate, propylene carbonate, ether lactate and the like. Various kinds of alcohols such as isopropyl alcohol, n-butyl alcohol, 2-butanol, isobutyl alcohol, tert-butyl alcohol, pentanols, benzyl alcohol, cyclohexanol, and the like.

In the case of the water ink that is jetted out as ink liquid droplets from the ink-jet head nozzles, in a process where the ink droplets contact with the surface of the printing paper and then permeate into the printing paper, the surface areas of the ink droplets are increased suddenly and sharply. For this reason, even if the surface tension of the ink is adjusted in the ink adjusting process such that it is 40 dyn/cm or less, when the surface tension of the ink in the interface between the ink and printing paper when the ink permeates into the printing paper exceeds 40 dyn/cm effectively, then the effect of the invention is caused to decrease. In view of this, in order to perform the effect of the invention to the full, even when the ink permeates into the printing paper, it is desirable that the ink should be adjusted such that the surface tension of the ink in the interface between the ink and printing paper can continue to be about 40 dyn/cm. In fact, it is difficult to measure the ink surface tension in the interface between the ink and printing paper when the ink permeates into the printing paper. To secure such desirable ink surface tension, the amount of addition of a surface tension adjusting agent may be set properly in consideration of the following phenomena results.

In other words, in general, when a surface active agent is added to ink, the surface tension of the ink becomes constant if the additive concentration (amount) of the surface active agent is equal to or greater than a critical micell concentration (c.m.c.). However, in the case of two kinds of ink which have the same surface tension under the condition that the additive concentration of the surface active agent is equal to or greater than the critical micell concentration, it is confirmed that the effects of the invention can be achieved more sufficiently in the ink having a higher concentration of the surface active agent than the ink having a lower concentration of the surface active agent. Of course, in this case, if the surface tension adjusting agent is added too much, then air bubbles are generated, ink jetting-out is worsened, and the ink is spread too excessively. This causes secondary obstacles: that is, the resolution of the printed image is lowered; the ink is caused to permeate into the printing paper too much, so that the ink can run through to the back side of the printing paper; and, the coloring density is worsened. Therefore, in order to avoid these problems, the concentration of addition of the surface tension adjusting agent must be examined deliberately.

Although it is difficult to regulate the amount of addition of the surface tension adjusting agent partly because the effect of the addition thereof varies according to the chemical structure thereof, in general, in the case of the surface tension adjusting agents which belong to the above-mentioned (1) group, about 0.1 to 5% by weight, preferably, about 0.8 to 2.0% by weight with respect to ink may be selected; and, in the case of the surface tension adjusting agents which belong to the (2) group, about 1 to 40% by weight, preferably, about 2 to 15% by weight may be selected. Of course, in the present invention, two or more kinds of surface tension adjusting agents belonging to the above-mentioned (1) and (2) groups can be combined and however, in this case as well, the amount of addition of such combined surface tension adjusting agents should be set properly in accordance with the above-mentioned amount of addition.

Besides the above-mentioned components, an anti-molding agent, a viscosity adjusting agent, a pH adjusting agent and the like can be added to the water ink.

Also, it is not specially necessary to regulate the viscosity of the water ink but, from the viewpoint of the ink jet-out stability and the image characteristic, the viscosity of the water ink at a temperature of 20° C. is preferably 1 to 8 cp and, more preferably, it is 1 to 5 cp.

For example, when images are printed on the printing paper of the invention by use of the water ink which has a surface tension of 40 dyn/cm or less, then good images can be formed and, at the same time, on ordinary paper including transfer paper for electronic photography such as L paper produced by Fuji Xerox (Co.) as well, there can be formed images in which the ink drying time is about 10 sec. or less when rush print images (1 cm×cm) are printed.

Due to the fact that the printing paper of the invention allows ink to be absorbed at a high speed and provides a large amount of ink absorbing capacity, even when a multi-color ink-jet printing operation is executed at a high speed and at a high density, the mixed color bleeding can be prevented sufficiently. Also, since the dye contained in the ink to be jetted out from the head nozzle can be caught effectively by the air gap of a white pigment having a high specific surface area in the paint layer of the printing paper, there can be provided a fresh coloring property and suitable dot spreading, so that there can be obtained images of high quality. Also, because the amount of paint to be applied when the paint layer is formed is slight, there can be obtained printing paper whose paint layer is excellent in strength and whose feeling and appearance are both almost similar to those of ordinary paper.

In addition, due to the fact that, in the above mentioned printing, by using the water ink whose surface tension at a temperature of 20° C. is 40 dyn/cm or less, the wettability of the ink relative to the base paper can be improved, the absorbing speed of ink into the base paper can be further enhanced and the mixed color bleeding can be prevented, so that there can be obtained more surely a high quality of image which is excellent in the coloring property and definition.

Description will be given below in more detail of the present invention by way of embodiment and comparisons. However, the invention is not limited to these embodiments.

[Manufacture of Printing Paper A to K]

A paper material including a filler and a size agent which are of the kind and content to be shown below was added to LBKP base pulp, which had been beat to a freeness of 500 ml C.S.F., in such a manner that an basis weight, a thickness and an apparent density as shown in Table 1 could be obtained, and the resultant product was considered as the paper. Also, in Table 1, there are shown the stöckigt size degrees of the respective sheets of base paper.

Filler

Printing Paper A: Light calcium carbonate (TP 121, Okutama Industry)—15% by weight Printing Paper B: Light calcium carbonate (TP 121, Okutama Industry)—15% by weight Printing Paper C: Kaolin clay (AA Kaolin, Sanyo Clay Industry)—10% by weight Printing Paper D: Light calcium carbonate (TP 121, Okutama Industry)—15% by weight Printing Paper E: Kaolin clay: AA Kaolin (Sanyo Clay Industry)—10% by weight Printing Paper F: Heavy calcium carbonate (Softon 1800, Bihoku Funka Industry)—15% by weight Printing Paper G: Light calcium carbonate (TP 121, Okutama Industry)—15% by weight Printing Paper H: Light calcium carbonate (TP 121, Okutama Industry)—15% by weight Printing Paper I: Light calcium carbonate (TP 121, Okutama Industry)—15% by weight Printing Paper J: Heavy calcium carbonate (Softon 1800, Bihoku Funka Industry)—15% by weight Printing Paper K: Heavy calcium carbonate (Softon 1800, Bihoku Funka Industry)—15% by weight Size Agent Printing Paper A: Alkyl ketene dimer system size agent (Sylene 70, Kao)—0.04% by weight Printing Paper B: Alkyl ketene dimer system size agent (Sylene 70, Kao)—0.04% by weight Printing Paper C: Rosin size (Size pine E, Arakawa Chemical Industry)—0.1% by weight Printing Paper D: Alkyl ketene dimer system size agent (Sylene 70, Kao)—0.04% by weight Printing Paper E: Alkynol succinic anhydride system size agent (Five run 81, Ohji National)—0.05% by weight Printing Paper F: Alkynol succinic anhydride system size agent (Five run 81, Ohji National)—0.05% by weight Printing Paper G: Alkyl ketene dimer system size agent (Sylene 70, Kao)—0.04% by weight Printing Paper H: Alkyl ketene dimer system size agent (Sylene 70, Kao)—0.04% by weight Printing Paper I: Alkyl ketene dimer system size agent (Sylene 70, Kao)—0.04% by weight Printing Paper J: Alkynol succinic anhydride system size agent (Five run 81, Ohji National)—0.04% by weight Printing Paper K: Alkynol succinic anhydride system size agent (Five run 81, Ohji National)—0.06% by weight.

Next, a paint solution composed of a white pigment, a binder and a water resisting agent, whose kind and content will be described below, was applied by a bar coater onto each of the base paper in such a manner that the paint had its dry weight as shown in Table 1, and after then the paint layer was finished so that the Beck smoothness of the surface of the pain layer had the following value, whereby there were obtained ink-jet printing paper A to G (embodiments) and H to K (comparisons). The BET specific areas of the respective white pigments are also shown in Table 1.

White Pigment

Printing Paper A: Fine grain synthesis non-crystal silica (Mizucasil P-802, Mizusawa Chemical Industry)—72% by weight Printing Paper B: Silica (Mizucasil P-78D, Mizusawa Chemical Industry)—72% by weight Printing Paper C: Silica (Mizucasil P-78D, Mizusawa Chemical Industry)—72% by weight Printing Paper D: Silica (Mizucasil P-802, Mizusawa Chemical Industry)—72% by weight Printing Paper E: Silica (Mizucasil P-78D, Mizusawa Chemical Industry)—72% by weight Printing Paper F: Silica (Mizucasil P-78D, Mizusawa Chemical Industry) 72% by weight Printing Paper G: Silica (Mizucasil P-526N, Mizusawa Chemical Industry)—72% by weight Printing Paper H: Silica (Mizucasil P-526N, Mizusawa Chemical Industry)—72% by weight Printing Paper I: Silica (Mizucasil P-526N, Mizusawa Chemical Industry)—72% by weight Printing Paper J: Silica (Mizucasil P-78D, Mizusawa Chemical Industry)—72% by weight Printing Paper K: Silica (Mizucasil P-78D, Mizusawa Chemical Industry)—72% by weight Binder Printing Paper A: Completely saponified poly-(vinyl alcohol) (PVA 117, Kuraray)—23% by weight Printing Paper B: Completely saponified poly-(vinyl alcohol) (PVA 117, Kuraray)—23% by weight Printing Paper C: Silanol group denatured vinyl alcohol copolymer (PVA 2130, Kuraray)—23% by weight Printing Paper D: Silanol group denatured vinyl alcohol copolymer (PVA 2130, Kuraray)—23% by weight Printing Paper E: Silanol group denatured vinyl alcohol copolymer (PVA 2130, Kuraray)—23% by weight Printing Paper F: Completely saponified poly-(vinyl alcohol) (PVA 117, Kuraray)—23% by weight Printing Paper G: Silanol group denatured vinyl alcohol copolymer (PVA 2130, Kuraray)—23% by weight Printing Paper H: Completely saponified poly-(vinyl alcohol) (PVA 117, Kuraray)—23% by weight Printing Paper I: Silanol group denatured vinyl alcohol copolymer (PVA 2130, Kuraray)—23% by weight Printing Paper J: Completely saponified poly-(vinyl alcohol) (PVA 117, Kuraray)—23% by weight Printing Paper K: Silanol group denatured vinyl alcohol copolymer (PVA 2130, Kuraray)—23% by weight Water Resisting Agent Printing Paper A: Water cation polymer (PAS-J11, Nittobo)—5% by weight Printing Paper B: Water cation polymer (Epomin P1000, Nihon Shokubai Industry)—5% by weight Printing Paper C: Water cation polymer (Epomin P1000, Nihon Shokubai Industry)—5% by weight Printing Paper D: Water cation polymer (PAS-J11, Nittobo)—5% by weight Printing Paper E: Water cation polymer (Epomin P1000, Nihon Shokubai Industry)—5% by weight Printing Paper F: Water cation polymer (Epomin P1000, Nihon Shokubai Industry)—5% by weight Printing Paper G: Water cation polymer (PAS-J11, Nittobo)—5% by weight Printing Paper H: Water cation polymer (Epomin P1000, Nihon Shokubai Industry)—5% by weight Printing Paper I: Water cation polymer (PAS-J11, Nittobo)—5% by weight Printing Paper J: Water cation polymer (Epomin P1000, Nihon Shokubai Industry)—5% by weight Printing Paper K: Water cation polymer (Epomin P1000, Nihon Shokubai Industry)—5% by weight Beck Smoothness Printing Paper A: 28 sec., Printing Paper B: 30 sec., Printing Paper C: 30 sec., Printing Paper D: 31 sec., Printing Paper E: 32 sec., Printing Paper F: 34 sec., Printing Paper G: 35 sec., Printing Paper H: 30 sec., Printing Paper I: 32 sec., Printing Paper J: 35 sec., Printing Paper K: 36 sec.

TABLE 1

| | | Printing paper (Embodiment) | | | | | | | Printing paper (Comparison) | | | |
|---|---|---|---|---|---|---|---|---|---|---|---|---|
| | | A | B | C | D | E | F | G | H | I | J | K |
| Base Paper | Basis weight (g/m$^2$) | 65 | 70 | 70 | 70 | 81 | 72 | 71 | 70 | 70 | 75 | 81 |
| | Thickness (g/m$^2$) | 100 | 100 | 100 | 100 | 109 | 91 | 90 | 100 | 100 | 90 | 90 |
| | Apparent density (g/cm$^3$) | 0.65 | 0.70 | 0.70 | 0.70 | 0.74 | 0.79 | 0.79 | 0.70 | 0.70 | 0.83 | 0.90 |
| | Stöckigt sizing degree | 9 | 9 | 3 | 9 | 8 | 10 | 9 | 30 | 9 | 8 | 14 |
| Paint layer | Pigment BET specific surface area | 300 | 300 | 200 | 200 | 300 | 300 | 200 | 300 | 100 | 300 | 300 |
| | Dry amount of paint applied (g/m$^2$) | 6 | 6 | 6 | 6 | 6 | 6 | 6 | 6 | 6 | 8 | 6 |

[Preparation of Water Ink A to C]

There were obtained ink sets A to C which are composed of the following kinds and contents of dyes and solvents of kinds and contents shown in Table 2. The surface tensions of the respective ink in the sets are also shown in Table 2.

TABLE 2

Dye

Black Ink: C.I Acid Black 56 --- 2.5% by weight
Cyan Ink: C.I Acid Blue --- 2.5% by weight
Magenta Ink: C.I Direct Red --- 2.5% by weight
Yellow Ink: C.I Direct yellow --- 2.5% by weight

| | Composition of Solvent (Content: Weight %) | | Surface tension (dyn/cm) | |
|---|---|---|---|---|
| Ink set A | Water | (77) | Black ink | 37 |
| | Ethylene glycol | (12) | Cyan ink | 38 |
| | Di-ethylene glycol | | Magenta ink | 37 |
| | Monobutyl ether | (85) | Yellow ink | 36 |
| Ink set B | Water | (77) | Black ink | 54 |
| | Di-ethylene glycol | (20.5) | Cyan ink | 53 |
| | | | Magenta ink | 55 |
| | | | Yellow ink | 52 |
| Ink set C | Water | (73) | Black ink | 32 |
| | Di-ethylene glycol | (20) | Cyan ink | 31 |

TABLE 2-continued

| Dye | |
|---|---|
| Black Ink: C.I Acid Black 56 | --- 2.5% by weight |
| Cyan Ink: C.I Acid Blue | --- 2.5% by weight |
| Magenta Ink: C.I Direct Red | --- 2.5% by weight |
| Yellow Ink: C.I Direct yellow | --- 2.5% by weight |

| Composition of Solvent (Content: Weight %) | | Surface tension (dyn/cm) | |
|---|---|---|---|
| Isopropyl alcohol | (3.5) | Magenta ink | 32 |
| Alkyl naphthalene sulfonic acid Na | (1) | Yellow ink | 31 |

[Embodiments 1 to 21, Comparisons 1 to 12]

A color recording test was conducted using the combination of the above-mentioned printing paper A to K and ink sets A to C which were combined in such a manner as shown in Table 3, as well as by use of a multi-color inkjet printer, that is, a printing device which includes four printing heads for black, cyan, Magenta and yellow each having a nozzle average jet-out capacity a=75 (ml), had a printing density performance of 300 dpi, the shortest inter-nozzle distance L to ink of different colors L=20 (mm) and head moving speed S=381 mm/s, and ink jet-out amount=20.9 ml/m$^2$ which can be expressed by $2ax^2/(0.0254)^2$ under the condition of T=L/S=0.52 sec.

On the images obtained in this manner, the fresh coloring property, definition and the strength of the paint layer were respectively studied and evaluated. Also, the ink absorbing capacity of the respective printing paper were respectively measured according to a method which is described below.

The results of the ink absorbing capacity and evaluations are shown in Table 3.

[Measurement of Ink Absorbing Capacity]

The ink absorbing capacity of the respective printing paper was measured by use of a dynamic liquid permeability testing machine (manufactured by Toyo Seiki Mfg.) according to the blister method of J. TAPPI.

That is, there was used a head box which has a slit dimension of 1 mm×15 mm, and the load to be applied to the head was set for 0.5 kg/cm$^2$. Also, the absorbing time in the testing machine was set for 0.052 (s) in order to be identical with the time T=L/S which can be determined by the shortest inter-nozzle distance L (mm) of different colors of the above-mentioned printer and the head moving speed S (mm/s). As the measuring liquid, there was used the cyan ink of the respective ink sets A to C to be actually combined and used. The ink absorbing capacity was measured under these conditions.

With respect to the mixed color bleeding, a rush image printed with Magenta ink and formed in a square having each side of 1 cm was printed superimposedly on the central portion of a rush image printed with cyan ink and formed in a square having each side of 2 cm, the super-imposed portion thereof was visually observed and confirmed in such a manner that the bleeding in the boundary portion between the cyan and red was considered as the mixed color bleeding in view of the fact that the superimposed portion becomes colored red in accordance with a subtractive mixture rule, and then the mixed color bleeding was evaluated on the basis of the following standards. That is, ⊙: No mixed color bleeding occurred, ○: Slight mixed color bleeding occurred, Δ: Small mixed color bleeding occurred, and ×: Mixed color bleeding occurred.

The coloring and clearness were confirmed by visually observing the color images and then were evaluated on the basis of the following standards. That is, ⊙: Very good, ○: Good, Δ: Ordinary, and x: Poor.

With respect to the definition, letters 濃(dense), and 富(wealth) were printed in Ming-style type and the understandability of the characters and then the qualities thereof were visually judged and were evaluated on the basis of the following standards. That is, ⊙: Understandability and quality of character are both very good, ○: Understandability and quality are both good, Δ: Character is somewhat defaced, and ×: Character is defaced.

With respect to the strength of the paint layer, the printing paper was folded, a metal roll of 2 kg was rolled on the folded portion of the printing paper, and the degree of peeling of the paint layer was evaluated on the basis of the following standards. That is, ⊙: Paint layer did not peel at all, ○: Paint layer peeled slightly, Δ: Paint layer peeled somewhat, and ×: Paint layer peeled fairly.

TABLE 3

| | Printing paper | Ink set | Ink absorbing capacity (ml/m$^2$) | Mixed color bleeding | Clear coloring property | defini-tion | Print layer strength |
|---|---|---|---|---|---|---|---|
| Embodiment 1 | A | A | 34 | ⊙ | ⊙ | ⊙ | ⊙ |
| Embodiment 2 | B | " | 31 | ⊙ | ⊙ | ⊙ | ⊙ |
| Embodiment 3 | C | " | 32 | ⊙ | ⊙ | ⊙ | ⊙ |
| Embodiment 4 | D | " | 26 | ⊙ | ⊙ | ⊙ | ⊙ |
| Embodiment 5 | E | " | 28 | ⊙ | ⊙ | ⊙ | ⊙ |
| Embodiment 6 | F | " | 24 | ○ | ○ | ○ | ⊙ |
| Embodiment 7 | G | " | 21 | ○ | ○ | ○ | ⊙ |
| Embodiment 8 | A | B | 28 | ⊙ | ⊙ | ⊙ | ⊙ |
| Embodiment 9 | B | " | 26 | ⊙ | ⊙ | ⊙ | ⊙ |
| Embodiment 10 | C | " | 27 | ⊙ | ○ | ⊙ | ⊙ |
| Embodiment 11 | D | " | 24 | ○ | ○ | ○ | ⊙ |
| Embodiment 12 | E | " | 24 | ○ | ○ | ○ | ⊙ |
| Embodiment 13 | F | " | 22 | ○ | ○ | Δ | ⊙ |
| Embodiment 14 | G | " | 21 | ○ | ○ | Δ | ⊙ |
| Embodiment 15 | A | C | 37 | ⊙ | ⊙ | ⊙ | ⊙ |
| Embodiment 16 | B | " | 34 | ⊙ | ⊙ | ⊙ | ⊙ |
| Embodiment 17 | C | C | 35 | ⊙ | ⊙ | ⊙ | ⊙ |
| Embodiment 18 | D | " | 29 | ⊙ | ⊙ | ⊙ | ⊙ |
| Embodiment 19 | E | " | 30 | ⊙ | ⊙ | ⊙ | ⊙ |
| Embodiment 20 | F | " | 27 | ⊙ | ⊙ | ⊙ | ⊙ |
| Embodiment 21 | G | " | 24 | ○ | ○ | ○ | ⊙ |

TABLE 3-continued

| | Printing paper | Ink set | Ink absorbing capacity (ml/m$^2$) | Mixed color bleeding | Clear coloring property | defini-tion | Print layer strength |
|---|---|---|---|---|---|---|---|
| Comparison 1 | H | A | 14 | x | ○ | x | ◎ |
| Comparison 2 | I | " | 12 | x | Δ | x | ◎ |
| Comparison 3 | J | " | 13 | x | ○ | x | ○ |
| Comparison 4 | K | " | 12 | x | ○ | x | ◎ |
| Comparison 5 | H | B | 11 | x | ○ | x | ◎ |
| Comparison 6 | I | " | 10 | x | Δ | x | ◎ |
| Comparison 7 | J | " | 10 | x | ○ | x | ○ |
| Comparison 8 | K | " | 10 | x | ○ | x | ◎ |
| Comparison 9 | H | C | 16 | x | ○ | Δ | ◎ |
| Comparison 10 | I | " | 14 | x | Δ | x | ◎ |
| Comparison 11 | J | " | 15 | x | ○ | Δ | ○ |
| Comparison 12 | K | " | 14 | x | ○ | x | ◎ |

As has been described heretofore, according to the invention, even when a multi-color ink-jet printing is executed at a high speed and at a high density, little mixed color bleeding occurs and there can be obtained an image of high quality which is excellent in the clear coloring property and definition. Also, according to the printing paper of the invention, since a slight amount of specific paint is applied to form a paint layer and thus the paint layer has a great strength, there is eliminated the possibility that the paper powder drop occur. Thus, the present printing paper is inexpensive in the cost thereof involved in the manufacturing process and also provides the feeling and appearance that are similar to ordinary paper.

Also, according to the invention, in the ink-jet printing using the present printing paper, by using water ink having a specific surface tension, the occurrence of the mixed color bleeding can be prevented for sure and there can be obtained an image which is more excellent in the fresh coloring property and definition.

What is claimed is:

1. Printing paper for a multi-color, multi-nozzle ink-jet printer which includes movable printing heads with a nozzle for different ink colors, each said head having a nozzle jet-out capacity, a, measured in amount of ink drop (ml), a print definition, x, and an inter-nozzle distance, L (mm), to ink of different colors and a printing paper/head relative moving speed, S (mm/s), said paper comprising:

base paper having an apparent density of 0.60 to 0.80 g/cm$^3$ and a stöckigt sizing degree of 2 to 18 sec; and a paint including a white pigment having a BET specific surface area of 200 to 400 m$^2$/g, said paint being applied to at least one surface of said base paper in such a manner that the amount of said paint when dried is in the range from 2 to 10 g/m$^2$, said paper having an ink absorbing capacity such that in a time T (sec) to be determined by the shortest inter-nozzle distance L (mm) of different ink colors of a multi-color ink-jet printer and a printing paper/head relative moving speed S (mm/s), by the formula T=L/S, the ink absorbing capacity V (ml/m$^2$) per unit area of said printing paper according to a blister method satisfies the following equation (1):

$$V \geqq 2ax^2/(0.0254)^2 \quad (1)$$

where a represents the amount of ink drop (ml) jetted out from one nozzle and x represents definition (dpi).

2. Ink-jet printing paper according to claim 1, filler being mixed in said base paper at a rate of 5 to 30 weight %.

3. Ink-jet printing paper according to claim 1, said base paper being made on conditions of basis weight of 50 to 100 g/m$^2$ and thickness of 65 to 150 μm.

4. Ink-jet printing paper according to claim 1, said white pigment having average particle diameter 2 to 15 μm and being mixed in said paint in a rate of 50 to 85 weight %.

5. Ink-jet printing paper according to claim 1, said base paper being treated in such a manner that a Beck smoothness is not less than 25 sec.

6. An ink-jet printing method, characterized in that, when performing a multi-color, multi-nozzle ink-jet printing operation by use of water ink in a multi-color, multi-nozzle ink-jet printer which includes movable printing heads with a nozzle for different ink colors, each said head having a nozzle let-out capacity, a, measured in amount of ink drop (ml), a print definition, x, and an inter-nozzle distance, L (mm), to ink of different colors and a printing paper/head relative moving speed, S (mm/s), there is used printing paper which comprises base paper having an apparent density of 0.60 to 0.80 g/m$^3$ and a stöckigt sizing degree of 2 to 18 sec and a paint including a white pigment having a BET specific surface area of 200 to 400 m$^2$/g, said paint being applied to at least one surface of said base paper in such a manner that the amount of said paint when dried is in the range of from 2 to 10 g/m$^2$, said paper having an ink absorbing capacity such that in a time T (sec) to be determined by the shortest inter-nozzle distance L (mm) of different ink colors of a multi-color ink-jet printer and a printing paper/head relative moving speed S (mm/s), by the formula T=L/S, the ink absorbing capacity V (ml/m$^2$) per unit area of said printing paper according to a blister method satisfies the following equation (1):

$$V \geqq 2ax^2/(0.0254)^2 \quad (1)$$

where a represents the amount of ink drop (ml) jetted out from one nozzle and x represents definition (dpi).

7. An ink-jet printing method as set forth in claim 6, wherein, as said water ink, there is used water ink which has a surface tension of 40 dyn/cm at a temperature of 20° C.

* * * * *

UNITED STATES PATENT AND TRADEMARK OFFICE

CERTIFICATE OF CORRECTION

PATENT NO. : 5,619,241

DATED : April 08, 1997

INVENTOR(S) : Kiyoshi HOSOI et al.

It is certified that error appears in the above-indentified patent and that said Letters Patent is hereby corrected as shown below:

Claim 6, column 16, line 36, "let" should read --jet--.

Signed and Sealed this

Twenty-third Day of September, 1997

*Attest:*

Bruce Lehman

BRUCE LEHMAN

*Attesting Officer*

*Commissioner of Patents and Trademarks*